US005664393A

United States Patent [19]

Veilleux et al.

[11] Patent Number: 5,664,393

[45] Date of Patent: Sep. 9, 1997

[54] STRUCTURAL WOODEN JOIST

[76] Inventors: Robert Veilleux, 115, Route 108, Saint-Victor, Québec, Canada, G0M 2B0; Mario Labrie, 335, avenue Duverger, Sainte-Marie Québec, Canada, G6E 3K7

[21] Appl. No.: 686,200

[22] Filed: Aug. 1, 1996

[51] Int. Cl.[6] ..... E04C 3/12

[52] U.S. Cl. ..... 52/729.4; 52/693; 52/650.1; 52/730.7

[58] Field of Search ..... 52/729.4, 729.2, 52/729.1, 730.7, 690, 693, 650.1

[56] References Cited

U.S. PATENT DOCUMENTS

| | | | |
|---|---|---|---|
| 3,626,653 | 12/1971 | Amirikian . | |
| 4,074,498 | 2/1978 | Keller et al. | 52/729.4 X |
| 4,191,000 | 3/1980 | Henderson | 52/729.4 |
| 4,228,631 | 10/1980 | Geffe | 52/730.7 X |
| 4,336,678 | 6/1982 | Peters . | |
| 4,580,922 | 4/1986 | Coppa . | |
| 4,803,824 | 2/1989 | Coppa . | |
| 4,827,688 | 5/1989 | Tene . | |
| 4,974,389 | 12/1990 | Onysko et al. | 52/729.4 |
| 5,267,425 | 12/1993 | Onysko et al. | 52/729.4 |
| 5,437,136 | 8/1995 | Triebel . | |
| 5,560,177 | 10/1996 | Brightwell | 52/729.4 |

FOREIGN PATENT DOCUMENTS

| | | |
|---|---|---|
| 112944 | 3/1968 | Norway . |
| 594275 | 2/1978 | U.S.S.R. . |
| 963141 | 7/1964 | United Kingdom . |
| 1367893 | 9/1974 | United Kingdom . |

*Primary Examiner*—Robert Canfield
*Attorney, Agent, or Firm*—Wheeler Kromholz & Manion

[57] ABSTRACT

The structural wooden joist described comprises a lower chord, an upper chord spaced from the lower chord and an openwork web structure joining the chords. The web structure includes, between opposite ends thereof, a series of horizontally spaced trapezoidal laminated panels defining a series of triangular spacings therebetween; each panel has opposite short and long sides adhesively joined to the lower and upper chords respectively and each panel is formed of short obliquely extending boards adhesively secured edgewise to one another.

9 Claims, 2 Drawing Sheets

STRUCTURAL WOODEN JOIST

FIELD OF THE INVENTION

The present invention pertains to a structural wooden joist used in building constructions.

BACKGROUND OF THE INVENTION

Wooden joist are used increasingly in a number of building applications. They comprise top and bottom elongate chords with intervening struts joined to the chords by means of scarfing. One such wooden joist may be found described in Canadian patent application 2,008,043 published Jul. 18, 1991 to Lemyre.

Some web structures have a triangular configuration, such as the joists described in U.S. Pat. No. 4,228,631 issued Oct. 21, 1980 to Geffe and Norwegian patent 112,944 granted May 6, 1968 to Greimbau-Lizenz GmBH. However, these structures are produced from a plywood or other reconstituted grade wooden panels either disposed on either side of the chords or disposed vertically above another and interconnected by a structural member. These panels are usually glued and nailed to the chords.

OBJECTS AND STATEMENT OF THE INVENTION

It is an object of the present invention to provide a novel wooden joist which consists in having a web structure wherein each panel is formed of short laminated boards which are adhesively secured to one another by gluing only thereby enabling an adjustment at the building location by a simple sawing operation.

The present invention therefore relates to a structural wooden joist which comprises:

a) an elongated lower chord;

b) an elongated upper chord in a spaced apart generally parallel opposed relation to the lower chord;

c) an openwork web structure joining the chords; the web structure including, between opposite ends thereof, a series of horizontally spaced trapezoidal laminated panels defining a series of triangular spacings therebetween; each panel having opposite short and long sides adhesively joined to the lower and upper chords respectively; each panel being formed of short obliquely extending boards adhesively secured edgewise to one another.

In one form of the invention, the short and long sides of the panel are secured to the chords by scarfing.

Preferably, the boards are made of kiln dry wood and selected from the group that includes fir, spruce and pine.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
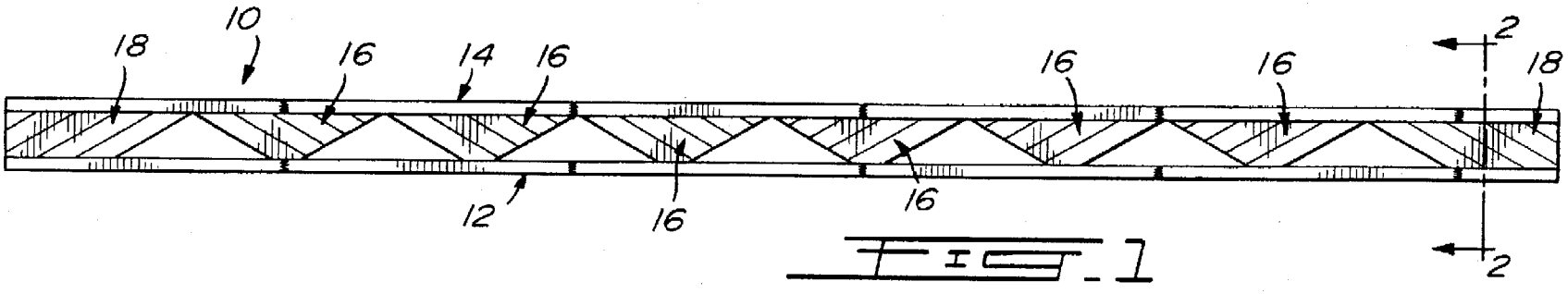
FIG. 1 is an elevational view of a wooden joist made in accordance with the present invention.

Referring to FIG. 1, there is shown a structural wooden joist, generally denoted 10, which comprises an elongated lower chord 12 and an upper chord 14 in spaced apart generally parallel opposed relation to the lower chord 12. Between the upper and lower chords is provided an open work web structure consisting of a series of panels horizontally displayed between two opposite end panels 18 and 20.

Figure 3:
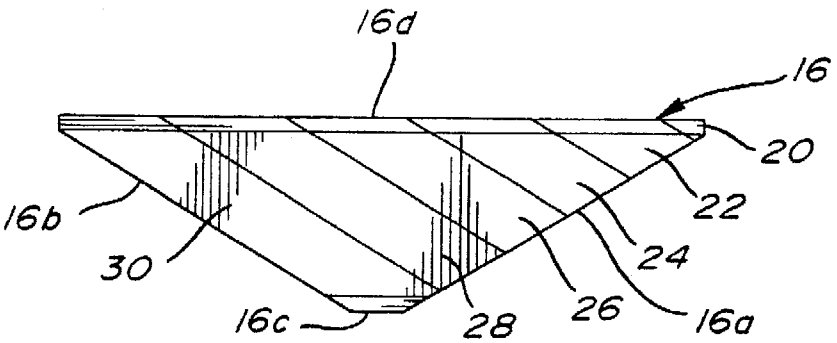
FIG. 3 is an elevational view of one trapezoidal panel used in the joist of FIG. 1.
Figure 2:
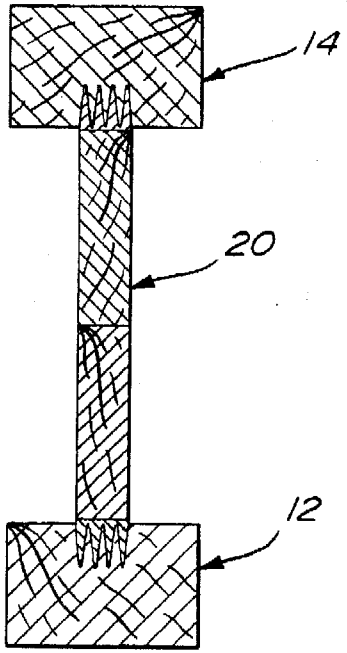
FIG. 2 is a cross-sectional view taken along lines 2—2 of FIG. 1.

Referring more particularly to FIG. 3, each panel 16 consists of a series of short obliquely extending boards 20, 22, 24, 26, 28 and 30 which are adhesively secured in an edgewise fashion to one another. The boards may also be formed of boards which are joined in an endwise manner by glue or scarfing.

Figure 4:
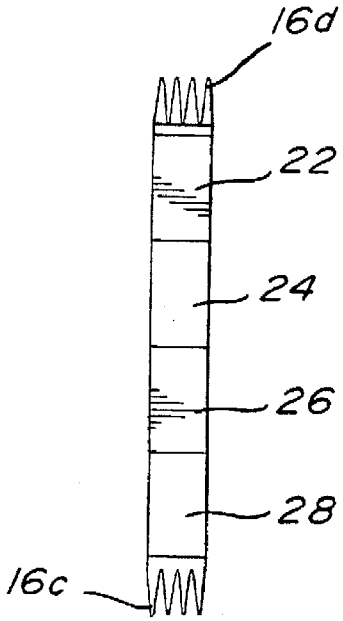
FIG. 4 is a side view thereof.

The trapezoidal panel 16 has two opposite inclined edges 16*a* and 16*b*, a short side 16*c* and a long side 16*d*. As can be seen in FIG. 4, the short side 16*c* and long side 16*d* have a finger scarfing configuration. Other connections can be used, such as those illustrated in U.S. Pat. No. 4,974,389 issued Dec. 4, 1990 to Onysko or U.S. Pat. No. 5,267,425 issued Dec. 7, 1993 also to Onysko.

Figure 5:
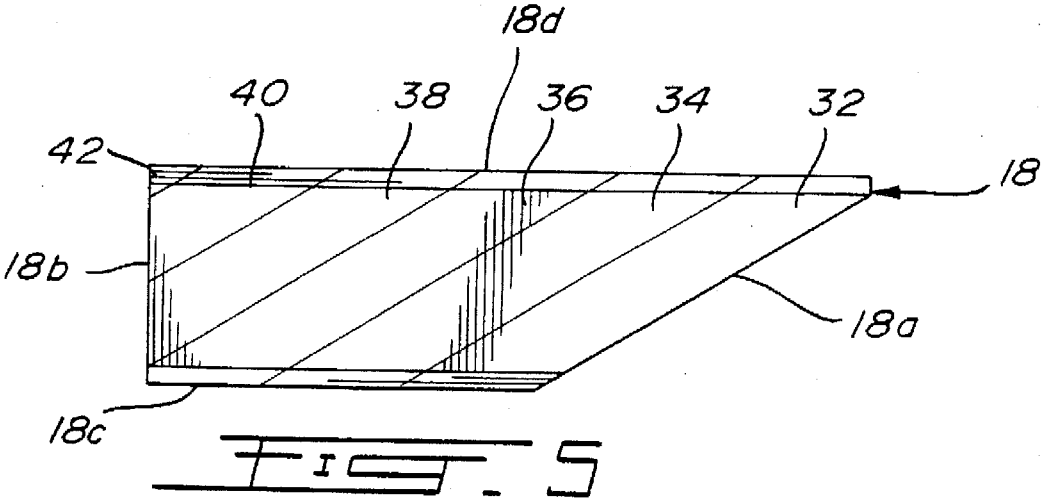
FIG. 5 is an elevational view of an end panel of the joist of FIG. 1.

Referring to FIG. 5, the two opposite end panels 18 and 20 have an identical configuration which is a four-sided structure that includes, in the case of panel 18, an oblique side 18*a* and an opposite side 18*b* which is perpendicular to a short side 18*c* and long upper side 18*d*. Again, this panel is formed of a series of obliquely extending boards 32, 34, 36, 38, 40 and 42 which are also adhesively secured to one another in an edgewise fashion. The opposite sides 18*c* and 18*d* also have a finger scarfing configuration similar to that of sides 16*c* and 16*d* of the panels 16.

All the boards used in the laminated panels 16, 18 and 20 are preferably disposed at an angle of 30° ; other angles however may be used in accordance with configuration and/or height of the joist.

Figure 6:
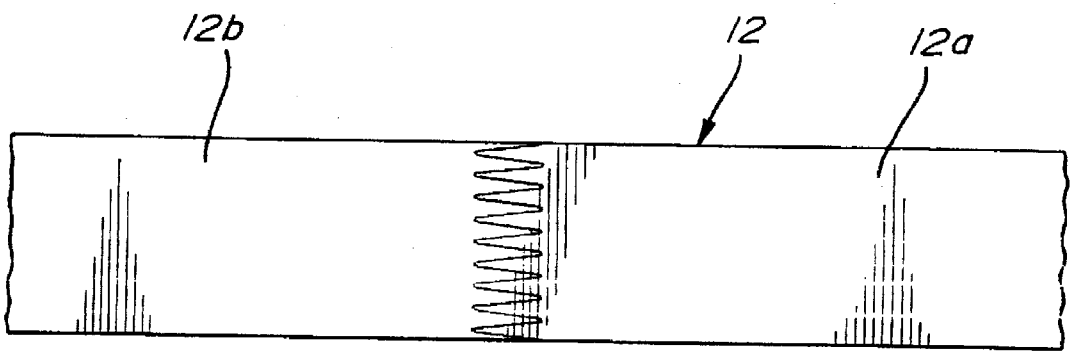
FIG. 6 is an enlarged elevational view of two chords sections connected together.

Referring to FIG. 6, the elongated chords may consist of a series of chord sections (two being shown as 12*a* and 12*b*) which are again interconnected by means of finger scarfing and glued to one another in an endwise manner. Preferably, the chords are pre-cambered.

The wood used for ail the boards of the panels is preferably kiln dry wood, selected from the group consisting of fir, spruce and pine. Also, the adhesive used in securing the boards together as well as that used in the finger scarfing sections is a glue preferably having a base of resin resorcinol, such as phenol-resorcinol resin.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A structural wooden joist comprising:

a) an elongated lower chord;

b) an elongated upper chord in a spaced apart generally parallel opposed relation to said lower chord;

c) an openwork web structure joining said chords; said web structure including, between opposite ends thereof, a series of horizontally spaced trapezoidal laminated panels defining a series of triangular spacings therebetween; each said panel having opposite short and long sides adhesively joined to said lower and upper chords respectively; each said panel being formed of short obliquely extending boards adhesively secured edgewise to one another.

2. A structural wooden joist as defined in claim 1, wherein said short and long sides of said panels are secured to said chords by scarfing.

3. A structural wooden joist as defined in claim 2, wherein said chords are substantially rectangular in cross-section.

4. A structural wooden joist as defined in claim 3, wherein each chord is formed of a series of successive boards joined horizontally by scarfing.

5. A structural wooden joist as defined in claim 1, wherein each said opposite ends of said web structure defines a laminated panel having horizontal top and bottom sides, an outer side extending perpendicularly to said chords and an inner side extending obliquely said chords; said panels of said opposite ends being formed of short obliquely extending boards adhesively secured edgewise to one another.

6. A structural wooden joist as defined in claim 5, wherein said boards are made of kiln dry wood.

7. A structural wooden joist as defined in claim 6, wherein said wood is selected from the group including fir, spruce and pine.

8. A structural wooden joist as defined in claim 1, wherein said boards of said laminated panels extend at 30° with respect to said upper and lower chords.

9. A structural wooden joist as defined in claim 1, wherein said boards are adhesively secured to one another by means of a glue having a base of resin resorcinol.

* * * * *